US008358089B2

(12) United States Patent
Hsia et al.

(10) Patent No.: US 8,358,089 B2
(45) Date of Patent: Jan. 22, 2013

(54) SOLID-STATE LIGHTING OF A WHITE LIGHT WITH TUNABLE COLOR TEMPERATURES

(75) Inventors: Chungho Hsia, San Jose, CA (US); Pai-Sheng Shen, Bellevue, WA (US)

(73) Assignee: Lightel Technologies Inc., Renton, WA (US)

( * ) Notice: Subject to any disclaimer, the term of this patent is extended or adjusted under 35 U.S.C. 154(b) by 377 days.

(21) Appl. No.: 12/776,384

(22) Filed: May 8, 2010

(65) Prior Publication Data

US 2011/0273107 A1 Nov. 10, 2011

(51) Int. Cl.

| | |
|---|---|
| ***H05B 37/00*** | (2006.01) |
| ***H05B 39/00*** | (2006.01) |
| ***H05B 41/00*** | (2006.01) |
| ***H01J 11/04*** | (2006.01) |
| ***H01J 13/48*** | (2006.01) |
| ***H01J 15/04*** | (2006.01) |
| ***H01K 13/00*** | (2006.01) |

(52) U.S. Cl. ..... 315/334; 315/260; 315/339; 315/341

(58) Field of Classification Search ..... None
See application file for complete search history.

(56) References Cited

U.S. PATENT DOCUMENTS

| | | | | |
|---|---|---|---|---|
| 2003/0067773 | A1* | 4/2003 | Marshall et al. | 362/231 |
| 2005/0127381 | A1* | 6/2005 | Vitta et al. | 257/88 |
| 2007/0223219 | A1* | 9/2007 | Medendorp et al. | 362/231 |
| 2007/0235639 | A1* | 10/2007 | Rains, Jr. | 250/228 |

* cited by examiner

*Primary Examiner* — Anh Tran
(74) *Attorney, Agent, or Firm* — Pai Patent & Trademark Law Firm; Chao-Chang David Pai

(57) ABSTRACT

A light-emitting diode (LED)-based solid-state device comprises a color mixing mechanism to dynamically change the correlated color temperature (CCT) of a white light. With different lumen proportions for white phosphor-coated LEDs and integrated red and green LEDs, the light mixtures can be located in any one of eight CCT quadrangles. In practice, CCTs of a white-light can be tuned in a continuous manner. Because all the possible light mixtures on the chromaticity diagram correspond to a line segment that overlays the Planckian locus within the eight CCT tolerance quadrangles, the effect of LED intensity fluctuations that may put the mixture out of white light region is reduced. Also, because the two additional LEDs that mix with the white phosphor-coated LEDs contribute to the overall spectral power distribution (SPD) that substantially matches the SPD of standard illuminants, a CRI of 80 can be reached.

14 Claims, 14 Drawing Sheets

SOLID-STATE LIGHTING OF A WHITE LIGHT WITH TUNABLE COLOR TEMPERATURES

BACKGROUND OF THE INVENTION

1. Field of the Invention

This invention relates to light-emitting diode (LED) lamps and more particularly to a white phosphor-coated LED lamp with tunable correlated color temperatures along the Planckian locus in the chromaticity diagram.

2. Description of the Related Art

Solid-state lighting (SSL) from semiconductor light-emitting diodes (LEDs) has received much attention in general lighting applications today. Because of its potential for more energy savings, better environmental protection (more eco-friendly, no mercury used, and no UV and infrared light emission), higher efficiency, smaller size, and much longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. For this trend, the Energy Star program specifies in CIE 1931 chromaticity diagram the range of chromaticities of white light recommended for general lighting with solid state lighting (SSL) products.

According to the CIE colorimetric system, a chromaticity coordinate (x, y) or (u', v') on the 1931 or 1976 chromaticity diagram is usually used to define a color. However, the chromaticity of a white light is more conveniently expressed by a correlated color temperature (CCT) and a distance from the Planckian locus, Duv. Whereas a nominal CCT is used to convey a specification of white light chromaticity for a product, a target CCT represents a value that the product is designed to produce. Although individual samples of the product may deviate from the target CCT due to production variations, they should be controlled to be within a tolerance. According to the Energy Star program, SSL products shall have chromaticity values that fall into one of eight nominal CCT categories, that is, 2700, 3000, 3500, 4000, 4500, 5000, 5700, and 6500 K, consistent with 7-step chromaticity quadrangles and Duv tolerances. In other words, SSL products with a given nominal CCT should have the defined target CCT and Duv, and the values of individual samples should be within the tolerances of the CCT and of the Duv. Two examples are given below. For the nominal CCT of 2700 K, the target CCT and Duv should have their tolerances such as 2725±145K and 0.000±0.006, respectively. For the nominal CCT of 4000 K, the target CCT and Duv should have their tolerances such as 3985±275K and 0.001±0.006, respectively.

To create a white light from LEDs, one may choose either one of two notable approaches—mixing of three or more primary color LEDs such as trichromatic or tetrachromatic RGB (red, green, and blue) LEDs or use of a blue or ultraviolet LED with wavelength down-conversion phosphor so as to have dedicated single color (e.g. warm-white, day-white or cool-white). For the first approach, LEDs with different dominant wavelengths emit narrowband light perceived as different saturated colors with spectral widths ranging from 20 to 35 nm. By using non-imaging optics to mix multicolor cluster of red, green, and blue LEDs with proper dominant wavelengths and proper intensity proportions, a white light with any correlated color temperature can be generated. For RGB color mixing, there are an infinite number of metamers due to metamerism. To generate a white light that meets the Energy Star requirements, accurate additive color mix proportions must be maintained during LED and lamp assembly production. This would involve extensive test for each LED used or introduction of active electronic control circuits to balance the LED output. In this case, the cost will be too high to produce such products economically.

Although a general multichip RGB with proper dominant wavelengths and proper intensity proportions can provide easy color management, it is not easy to stabilize a specific chromaticity over time while LED junction temperatures change from ambient temperature to 120° C. or higher because individual LED exhibits different thermal dependencies. For example, as the junction temperature changes from 20 to 100° C., the intensity can change 60% and 20% for red and amber AlInGaP LEDs and blue InGaN LEDs, respectively. Temperature also affects the peak emission wavelength with a 0.3 to 0.6 nm/° C. drift. Moreover, the LEDs may degrade in brightness and change in color over time. In specific lighting applications, a plurality of LEDs must be used in a lamp to generate enough lumen output. Individual LED used in these LED clusters, however, has different spectral and electrical properties although its nominal characteristics are the same. It is also true that even in a batch of LEDs produced, the optical and electrical properties of LEDs may vary due to defects in the materials and variations in the manufacturing process. Furthermore, the spectral and electrical properties of LEDs are significantly affected by their junction temperatures, which further depend on LED chip design and specifications, and operating conditions. Such variability of the optical and electrical properties can cause different LEDs to deteriorate at different rates. In this case, even a small intensity change that in turn results in a change of the emitted RGB proportions can present perceptible color shifts.

To deal with these thermal issues, one may use optical and thermal feedback or feed-forward circuit to maintain the chromaticity to within one MacAdam ellipse, especially if the luminaire is being dimmed while the LED junction temperatures vary rapidly. Nevertheless, the approach is too expensive to be adopted in practice. It is, therefore, the purpose of the present invention to provide a scheme effectively alleviating such thermal dependence of color shifts.

The second approach in generating a white light involves use of phosphor-coated LEDs (pcLEDs)—blue-emitting InGaN LEDs coated with one or more layers of phosphors such as cerium-doped yttrium aluminum garnet (YAG). The phosphors down-convert a portion of the emitted light to a wideband yellow light which in turn mixes with the primary blue emission to generate a white light perceived as "cool" white with color temperatures ranging from 4500 K to 10000 K. The advantages of phosphor-converted white LEDs include relatively low cost and great color stability over a wide range of temperatures. However, white pcLEDs suffer from a lower efficiency than normal LEDs do on account of the heat loss from the Stokes shift and other deterioration mechanisms of phosphors. Because the design and production of an LED lighting system using such narrowband emitters with phosphor conversion is simpler and less expensive than that of a complex RGB system, the majority of high intensity white pcLED lighting systems today on the market are produced using phosphor conversion.

Conventional white pcLEDs encounter a fundamental trade-off between color rendering index (CRI) and the luminous efficacy. The CRI, determined by spectral power distribution (SPD) of a light source, is a critical characteristic of the light source in general lighting applications. High CRIs generally require a broad emission spectrum distributed throughout the visible region; the sun, blackbody radiation, and almost all incandescent bulbs emit a white light with a CRI of 100. In general, CRI values in the 70s are considered acceptable, whereas the Energy Star program requires integral LED lamps to have a minimum CRI of 80. Currently available warm-white pcLEDs with low color temperatures provide wider SPD and better CRI than cool-white pcLEDs do, but phosphors used in warm-white LEDs are inefficient in providing lumen output in comparison with RGB LED clusters. Therefore, when energy efficiency and high color consistency at low color temperatures are required, LED clusters are recommended. Conversely, when these parameters are less important, or when accurate color rendering is not required, cool-white and warm-white pcLEDs should be adopted. However, if such pcLEDs are mixed with red and green LEDs, efficiency will not decrease even at low color temperatures, taking advantage of higher efficiency for cool-white and RG LEDs than warm-white pcLEDs. This will be discussed in detailed description of the present invention below.

To change color temperatures, one may use a dimmer in an incandescent lamp. When the lamp is dimmed, temperature of its filament decreases. The emitted light looks "warmer". Further dimmed, the lamp emits light with a color changing from white to yellow, to orange, and to red. Though, the luminous efficacy of the lamp decreases. Most of "white" LEDs are based on blue LEDs with a phosphor coating that generates warm or cool white light. When dimmed, the white light does not appear red but even more bluish. As for white light created by using RGB LED clusters, its color temperature can be modified using different color mixing, but overall LED efficacy decreases with dimming because driver efficiency decreases at low dimming levels.

As LED lighting becomes more popular for home applications, fully integrated LED dimming controls will become a necessity in new houses while LED products need to retrofit and to work with dimmers originally designed for incandescent products. It is, therefore, the purpose of the present invention to use such dimmers only as human interface to control color temperature of the light mixture of cool white light and red and green light, without dimming or changing lumen output of the light.

A prior embodiment of a white light relates to producing nearly achromatic light by additively combining complementary colors from two types of colors of saturated LED sources or their equivalents. It seems that this technique can provide all desired white illuminations in the CCT domain specified in the Energy Star program. In practice, however, this is not the case because red, green, and blue LEDs drift in intensity and wavelength over time and temperature. On the other hand, the simple mixture of two complementary colors or three red, green, and blue colors create a white light with rather poor color rendition. These difficulties render such LED products unsuitable for wide applications.

FIG. 1 is a CIE 1976 UCS chromaticity diagram expressed by (u', v') coordinates. FIG. 1 also shows five saturated colors 10, 20, 30, 40, and 50 at dominant wavelengths of 400, 480, 500, 580, and 770 nm, respectively. The eight quadrangles 80 that specify available white color region 70 of SSL are along the Planckian locus 60. Each of the eight quadrangles is defined by the range of CCT and the distance from Planckian locus on the diagram. FIG. 2 is an enlarged view in the white light region with eight quadrangles 11, 12, 13, 14, 15, 16, 17, and 18, representing eight CCT categories at nominal CCTs of 2700, 3000, 3500, 4000, 4500, 5000, 5700, and 6500 K, respectively. The tolerance quadrangles for 2700 K are defined by four (u', v') coordinates (0.2666, 0.5384), (0.2535, 0.5325), (0.2573, 0.5155), and (0.2696, 0.5209). Similarly, the tolerance quadrangles for 3000 K are defined by (0.2535, 0.5325), (0.2409, 0.5251), (0.2458, 0.5087), and (0.2573, 0.5155). The tolerance quadrangles for 3500 K are defined by (0.2409, 0.5251), (0.2277, 0.5148), (0.2339, 0.4994), and (0.2458, 0.5087). The tolerance quadrangles for 4000 K are defined by (0.2272, 0.5161), (0.2165, 0.5052), (0.2238, 0.4909), and (0.2334, 0.5007). The tolerance quadrangles for 4500 K are defined by (0.2165, 0.5052), (0.2095, 0.4964), (0.2176, 0.4831), and (0.2238, 0.4909). The tolerance quadrangles for 5000 K are defined by (0.2088, 0.4975), (0.2026, 0.4884), (0.2114, 0.4760), and (0.2169, 0.4842). The tolerance quadrangles for 5700 K are defined by (0.2026, 0.4884), (0.1970, 0.4784), (0.2063, 0.4672), and (0.2114, 0.4760). The tolerance quadrangles for 6500 K are defined by (0.1961, 0.4793), (0.1905, 0.4676), (0.2005, 0.4576), and (0.2055, 0.4682).

Six 7-step MacAdam ellipses 100 overlap the eight quadrangles, showing that nominal CCTs for SSL are consistent with those for fluorescent lamps complying with Energy Star requirements. FIG. 3 illustrates how the additive mixture of light from two LEDs having complementary hues can be combined to form a metameric white light. As shown, the combined beam of two LEDs with complementary hues 110 and 120, one emitting at 493 and the other emitting at 700 nm, respectively, produces a white light 130 located close to CCT of 6504K on the Planckian locus, which is one of standard illuminants, D65, used in CIE colorimetric system. FIG. 3 also depicts a prior art utilizing a combination of two LEDs whose emissions have peak wavelengths 140 and 150 at 505 nm and 615 nm, respectively, to form a white light with a CCT of 2700K near the other standard illuminant A 160 at 2856K. Also shown is a combination of two LEDs whose emissions have peak wavelengths 170 and 180 at 500 nm and 650 nm, respectively, forming a white light 190 with a CCT of 3500K on the Planckian locus. In the same fashion, a combination of two LEDs whose emissions have peak wavelengths from 493 to 505 nm (perceived as green) and from 615 to 700 nm (perceived as red) can cover the entire white light region on the CIE chromaticity diagram.

The drawbacks for this color mixing are two folds: First, because various possible combinations of two LEDs represent a line segment that is substantially perpendicular to the Planckian locus 60, not only wavelength but intensity variations can change coordinates of a resultant color combination such that the resultant coordinate can easily fall outside of white region. Second, the color rendition is poor because there are only two LEDs with narrow spectral width contributing the overall spectral power distribution that is far from that of standard illuminant A or D65.

FIG. 4 is an illustration of a prior art showing color mixing of RGB colors to generate a white light in CIE chromaticity diagram. On the diagram, 210, 220, and 230 represent blue, green, and red colors at wavelengths of 480, 520, and 680 nm, respectively. Area 200 represents chromaticity coordinates of all the possible resultant mixtures of these RGB LED clusters with a contour 205 representing a locus of additive mixtures from these RGB LEDs. As shown, the white light region is small part of this area; any improper combinations of RGB colors due to temperature-dependent intensity fluctuations or wavelength drift will result in a desired chromaticity coordinate out of this white light region. Also shown are three points 240, 250, and 260, representing three possible intermediate wavelengths that can combine 210 at 480 nm to form white lights in the white light region. However, none of the three light mixtures can cover entire white region with Duv within 0.006, meaning that a perceivable color shift occurs.

FIG. 5 is a block diagram using color mixing of RGB LEDs in a prior art. AC or DC power supplies provide power source to the three LED drivers which in turn power red, green, and blue LED arrays with appropriate electric currents based on the control signals sent from a driver controller that determine correct intensity proportions. The light emissions from three LED arrays are mixed using diffuser or mixing optics and thus generate a white light mixture.

To create white light using color mixing and enhance the usage of the yellowish LEDs and red LEDs, Antony Paul Van De Ven, et al. suggests in their patent (U.S. Pat. No. 7,213,940 B1) that two groups of LEDs with different color hues be mixed. As shown in FIG. 6, the first group of LEDs emitting yellowish light has (x, y) color coordinates within an area on the 1931 CIE Chromaticity Diagram defined by points 310, 320, 330, 340 and 350 having coordinates (0.2105, 0.50), (0.1788, 0.5028), (0.1791, 0.5373), (0.2281, 0.5371), and (0.2333, 0.525), respectively. The second group of LEDs emits light having a dominant wavelength in the range from 600 nm (360) to 630 nm (370). Mixing of these two color hues at proper proportions produces a mixture of light having a (u', v') coordinate on a 1976 CIE Chromaticity Diagram, which defines a point within MacAdam ellipses of at least one point on the blackbody locus on the Diagram.

As mentioned, LEDs, when operating, intensity fluctuates, and wavelength drifts over time and temperatures. Different LEDs have different drift rates on these two parameters. Therefore, when the two groups of LEDs drift differently, and mixing ratio changes, the (u', v') coordinates of the mixture of light may easily shift outside the six MacAdam ellipses on the blackbody locus on the 1976 CIE chromaticity diagram. What is the worst is that the corresponding coordinates of these two groups of LEDs are in the opposite sides of the Planckian locus. The substantial variations inherent to conventional discrete and individual chip LEDs will cause the coordinates of the resultant additive mixture to traverse the u', v' chart in a direction generally substantially perpendicular to the Planckian locus into either the yellowish pink (above the Planckian locus) or the yellowish green (below the Planckian locus) region of the u', v' diagram.

In many applications of commercial and residential lighting, a white light with reasonably high color fidelity is required. In this area, a white pcLED lamp is used to replace an existing incandescent and halogen bulbs, taking advantages of LED's features. In a floor lighting application, an LED lamp is used to replace a solar light lamp because the latter consumes much power. Use of a high intensity discharge (HID) lamp instead creates much heat and causes the cooling system to consume more energy to cool down the area the lamp located. LED lamps, however, can provide enough lumen output, do not generate heat, and thus are well suited for this application. Both solar light lamps and HID lamps have high color fidelity with color rendering index close to 100 whereas pcLEDs only have a CRI of 70 or less. LED lamps must have improved CRI to justify the replacement, in addition to energy savings. Prior arts that adopt white pcLEDs or RGB LED clusters obviously cannot meet the requirements.

SUMMARY OF THE INVENTION

The present invention provides a scheme to realize CCT tunability by using color mixing of emissions of white pcLEDs at a CCT around 6500K and saturated LEDs at a wavelength around 583 nm or an intermediate wavelength of a light mixture of 530 nm and 630 nm. Because various possible light mixtures of the white pcLEDs and the intermediate wavelength represent a line on the CIE 1976 u', v' diagram, and this line overlays Planckian locus and 7-step chromaticity quadrangles, variations of the LED intensity and the associated intensity proportions of the LEDs used change the resultant coordinates substantially along the Planckian locus in such a way that the Duv is kept within 0.006. In other words, this scheme effectively alleviates thermal dependence of the color shifts. By using two LEDs at wavelengths of 530 nm and 630 nm to broaden the overall spectral power distribution (SPD) of the light mixture such that its SPD substantially covers the SPD of standard illuminants, the approach provides a means to mass produce LED-based down light and panel light while maintaining a CRI greater than 80.

DETAILED DESCRIPTION OF THE INVENTION

Figure 1:
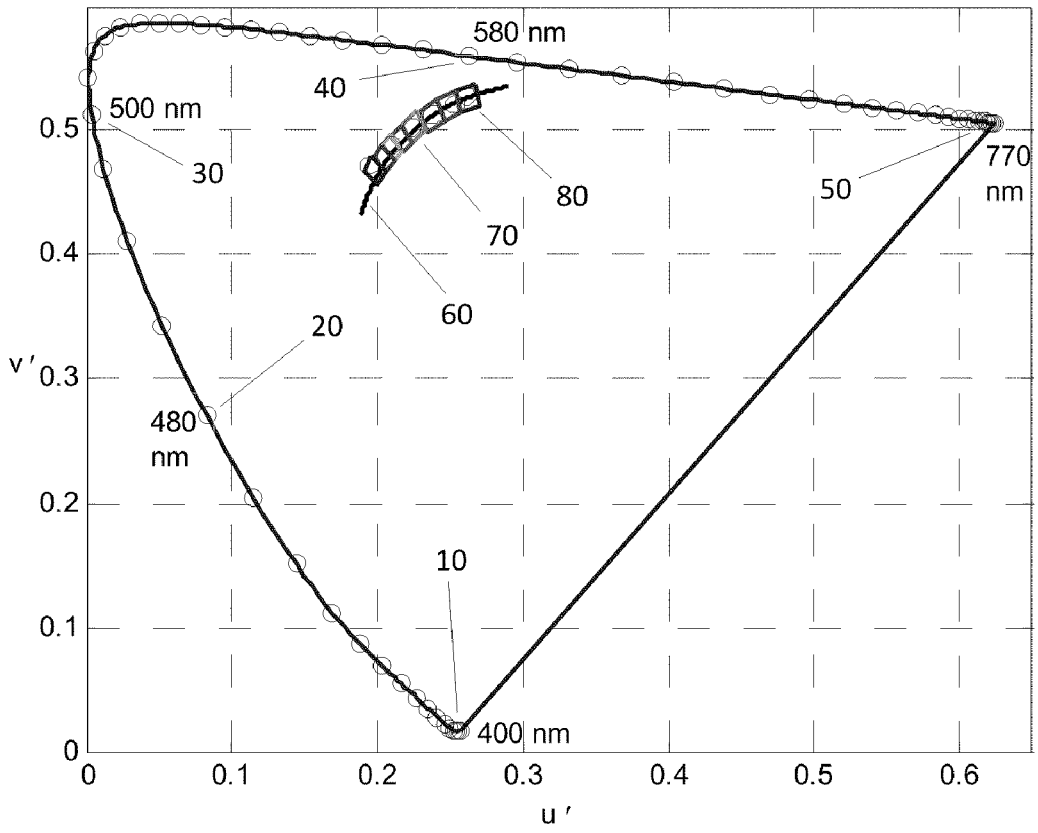
FIG. 1 is an illustration of a CIE chromaticity diagram with Planckian locus.
Figure 2:
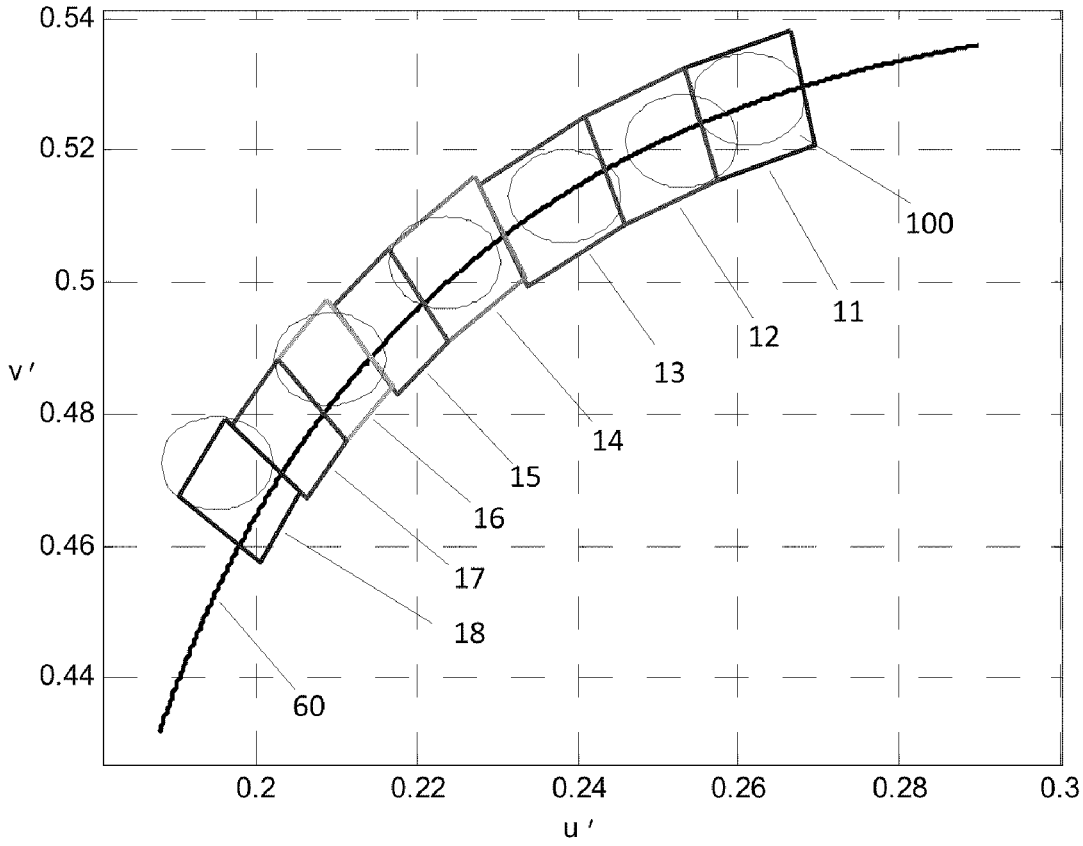
FIG. 2 is an enlarged view showing eight CCT quadrangles with six 7-step MacAdam ellipses.
Figure 3:
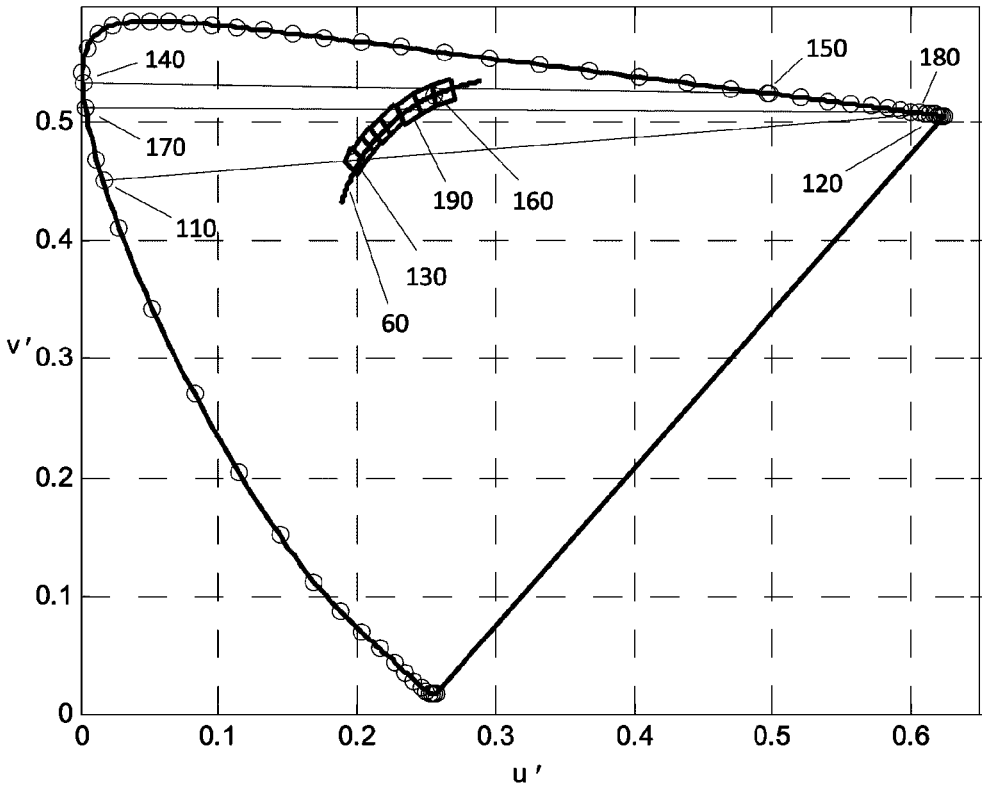
Fig. 3 Prior Art
FIG. 3 illustrates color mixing of two complementary colors.
Figure 4:
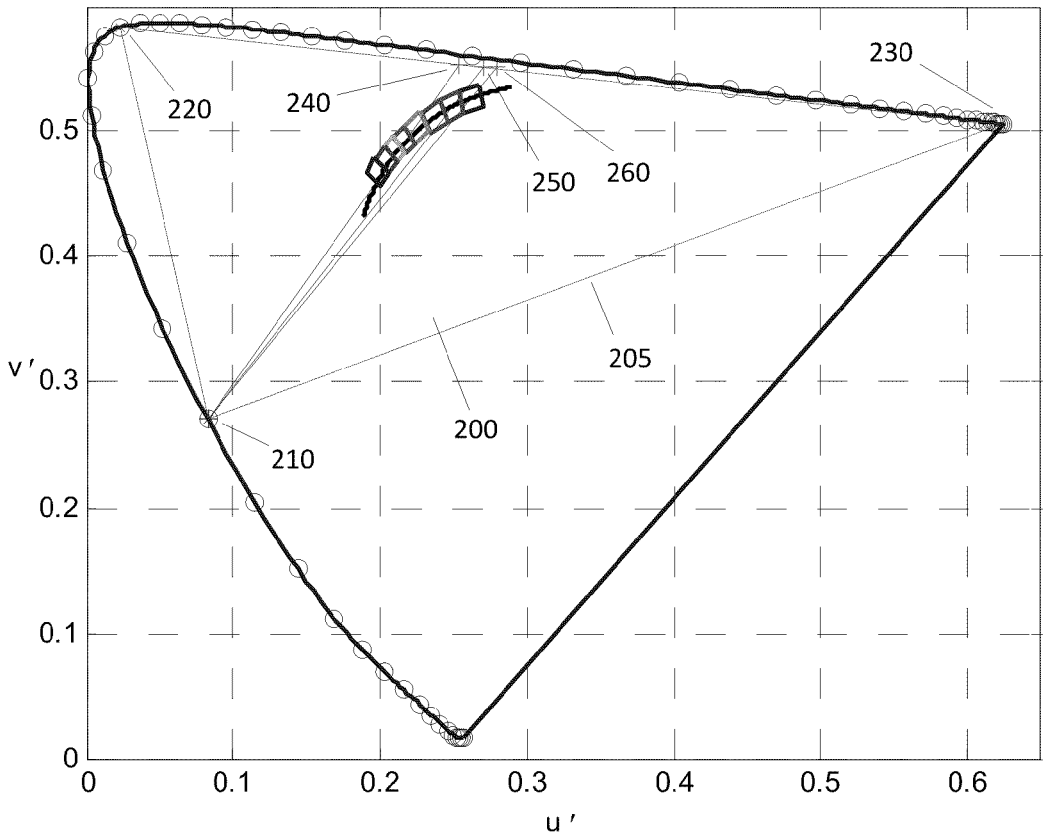
Fig. 4 Prior Art
FIG. 4 illustrates color mixing of red, green, and blue colors to generate a white light in a prior art.
Figure 5:
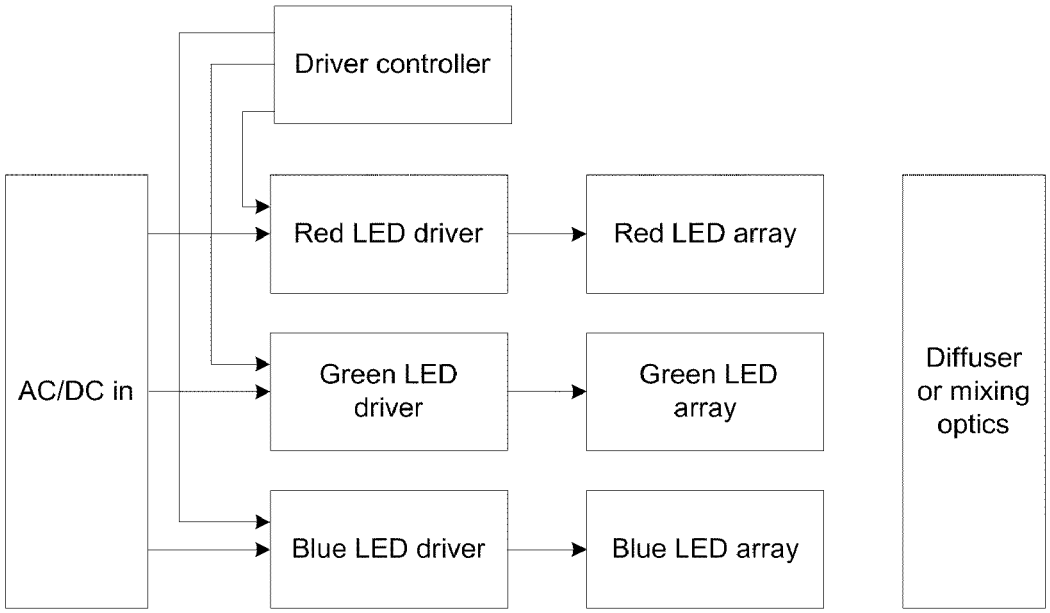
Fig. 5 Prior Art
FIG. 5 is a block diagram showing color mixing of RGB LEDs in a prior art.
Figure 6:
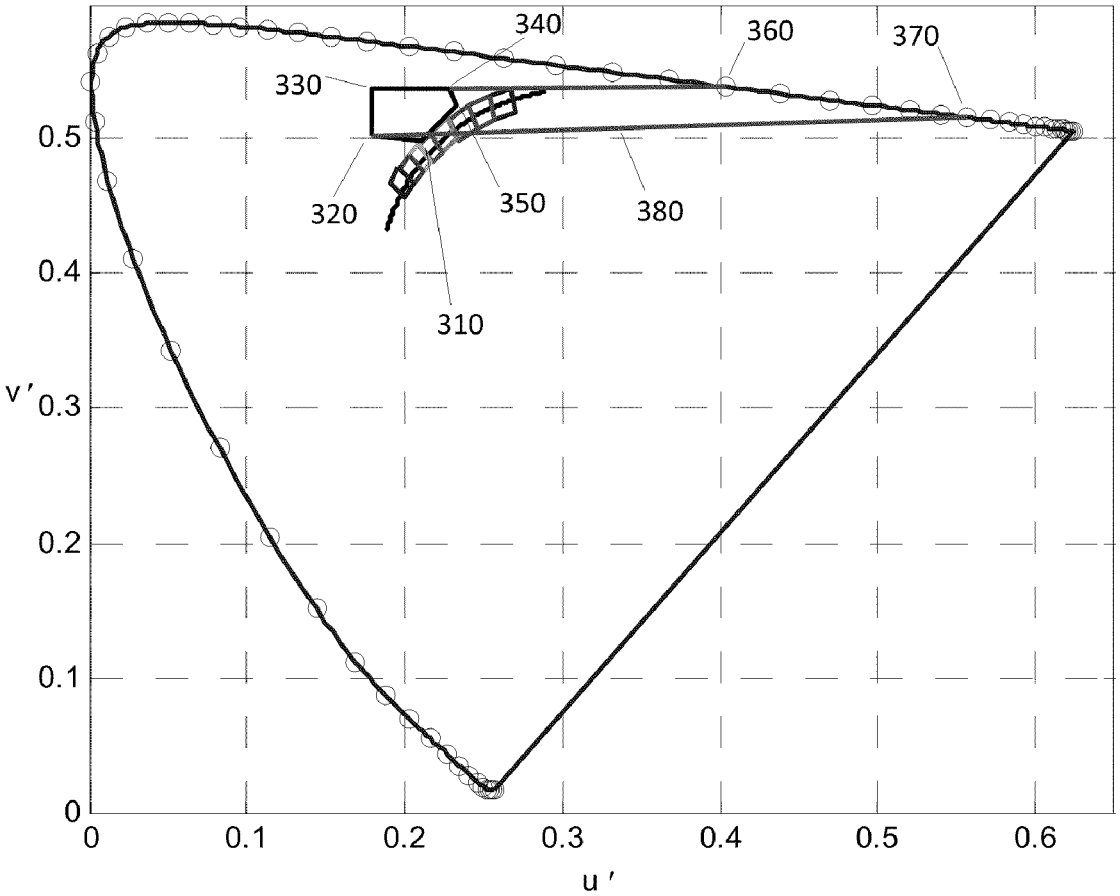
Fig. 6 Prior Art
FIG. 6 illustrates color mixing of yellowish LEDs and red LEDs in a prior art.

Although consumers demand a tunable CCT lighting such as warm-white, sun-white, natural-white, or cool-white to help improve the atmosphere in their working, exhibiting, or living areas, there have been no such lighting products in the lamp market. A conventional LED-based recessed down-light or light panel contains tens or hundreds of LEDs to provide enough lumen output with a moderate CRI to replace conventional solar light, HID lamp, incandescent bulbs, fluorescent tubes, halogen lamps, etc. It is not possible for such conventional lightings to tune their CCTs. LED-based lamps, however, provide the easiest way for such CCT tunability. Therefore, a residential or commercial consumer is most likely to buy such solid-state lighting (SSL) because of this feature rather than a simple consideration of energy savings and extended lifetime of the SSL.

In general lighting applications, a solid-state white light with a CRI greater than 80 and within one of eight correlated color temperature categories, each consistent with the 7-step chromaticity quadrangles and Duv tolerances of 0.006 is needed to meet Energy Star requirements. In addition, the color must be maintained within 0.007 on the CIE 1976 u', v' diagram over its expected lifetime of 50,000 hours. Without delicate designs and good thermal management, the solid-state lighting is less likely to meet upcoming stricter energy and quality requirements.

As mentioned, CRI represents how well a light source renders the true colors of different objects and its value depends on how close the spectral power distribution (SPD) of the test illuminant matches that of the reference illuminant, which is standard illuminant A or D65. Being a monochromatic light source, an LED has a spectral power distribution that peaks at a specific wavelength and tails elsewhere in the spectrum. White pcLEDs then have primary blue emission from LED chips covered with phosphor emission from a layer of phosphor, thus leading to a peak at 450 nm in the blue region and another peak at 550 nm for the wideband phosphor emission with one valley in the 475 nm-region. Although such peaks and valley form two spectral bands in the spectrum, they do not change the chromaticity coordinates nor the CCT of an LED light, but may dramatically change the CRI of the LED light. In other words, two white lights having the same CCT and chromaticity coordinates may exhibit different color rendition. For example, a test illuminant created using red, green, blue (RGB) LEDs and the reference illuminant may both have the same CCT and chromaticity coordinates but have a CRI of 20 and 100, respectively. Clearly there are differences between the two SPDs that cause the deterioration in CRI. In principle, color mixing can be applied in order to reduce SPD differences between the test and reference illuminants and to create a white light with a high CRI. But without rather delicate simulations, color mixing may fail to increase CRI significantly.

White pcLEDs provide a simple and less expensive solution to create white light but do not provide a high CRI over a wide range of color temperatures. The present invention introduces a novel scheme to dynamically change the correlated color temperatures of the LED light source with improved color stabilization in white light region, efficacy, and CRI that meet or exceed the Energy Star requirements.

Figure 7:
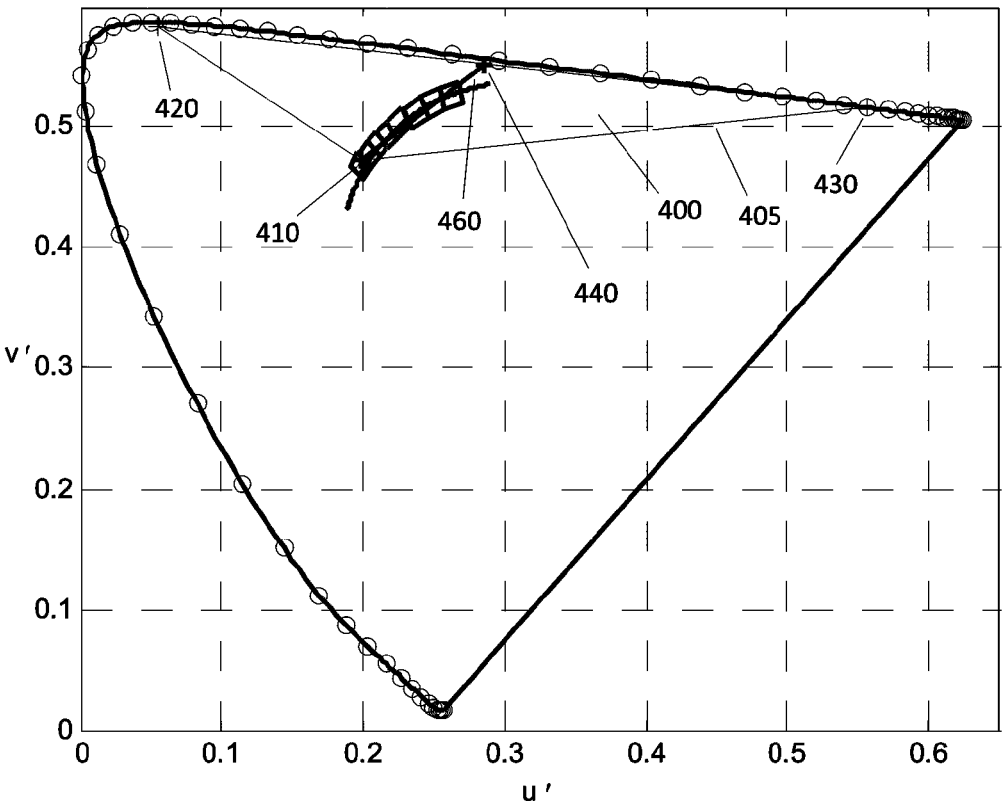
FIG. 7 illustrates color mixing of white and integrated red and green LEDs according to present invention.
Figure 8:
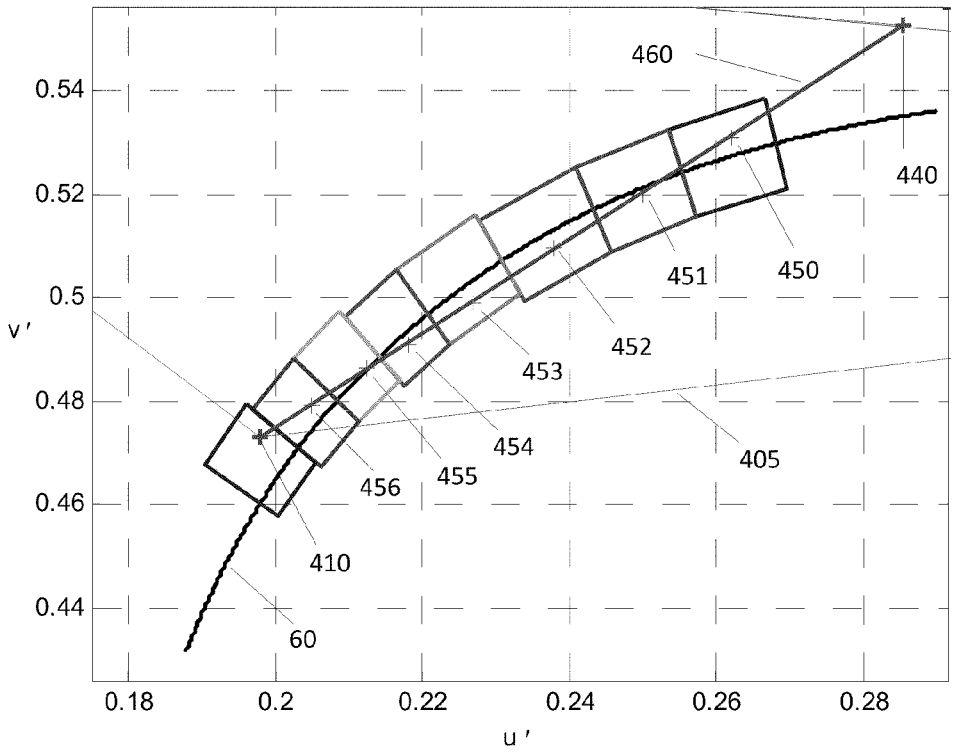
FIG. 8 is an enlarged view of FIG. 7, showing eight coordinates corresponding to eight CCTs in the white light region.

FIG. 7 illustrates color mixing of the white and red and green LEDs on the chromaticity diagram according to present invention. FIG. 8 is an enlarged view of FIG. 7, focusing on the eight white-light quadrangles. Referring to FIGS. 7 and 8, there are two groups of LEDs, one being white pcLEDs emitting a white light at CCT of 6500 K or a (u', v') coordinate 410 at (0.198, 0.473) and the other being integrated red and green LEDs emitting at an intermediate wavelength of 583 nm or a (u', v') coordinate 440 at (0.28547, 0.55266).

Figure 9:
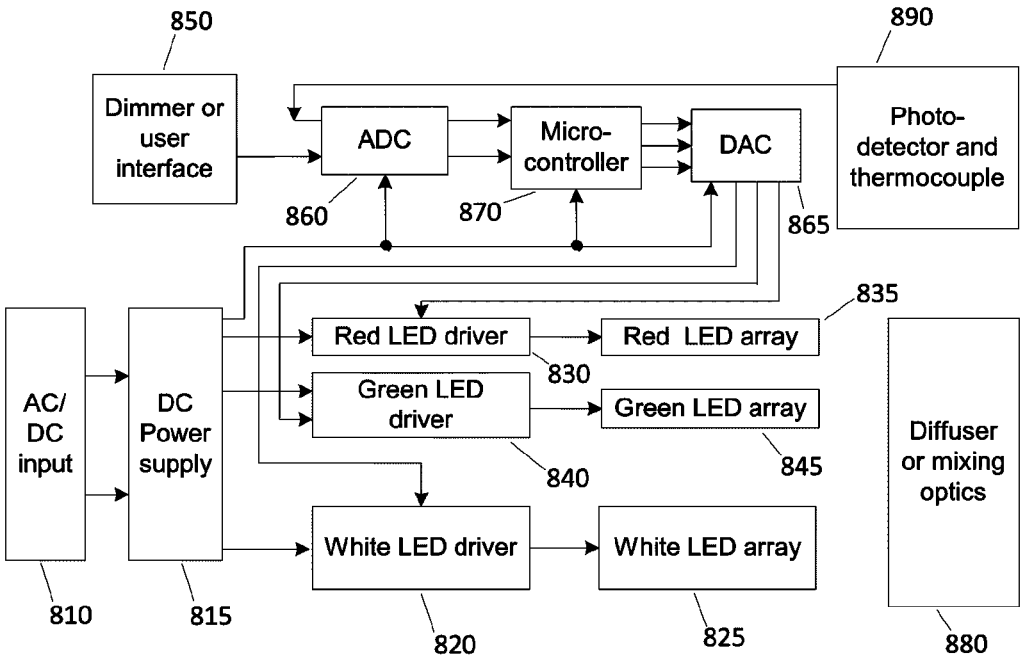
FIG. 9 is a block diagram showing functional mechanisms for tuning CCTs according to the present invention.

FIG. 9 is a functional block diagram showing color mixing of a white pcLED and integrated red and green LEDs according to the present invention. In the figure, a DC power supply 815 receives a power from AC or DC input 810 and supplies rated voltages to the associated components. An analog-to-digital converter (ADC) 860 receives an analog signal from a dimming switch or a different form of user interface 850, converts the analog signal to a digital signal, and sends it to a micro-controller 870, which then calculates a lumen proportion needed for emissions from the white pcLEDs 825 and the red and the green LEDs 835 and 845 so that the resultant light is at a target CCT that a user wants. To maintain the total lumen output, the micro-controller 870 also regulates the electric current based on signals from a thermocouple and a photo-detector 890 on a LED printed circuit board (LED PCB) using built-in mathematical equations and LED parameter database such as LED efficacy, intensity-temperature relations, color shift-temperature relations, the eight CCT quadrangles, etc. In the meantime, the micro-controller 870 also calculates the minimum number of LEDs needed to achieve the target CCTs and CRI while maximizing the lumen output in order to enhance the luminaire efficacy as specified by the Energy Star program. The original lumen output is set to be 2000 lumens, emitting entirely from the white pcLEDs 825. When a dimming switch or a user interface 850 is placed by a user to the dimmest position, the micro-controller 870 determines that the white pcLEDs 825 and the red LEDs 835 and the green LEDs 845 should emit 560, 66, and 779 lumens, respectively; the proportion is 0.28:0.33:0.39. The micro-controller 870 then calculates electric current needed to drive the LEDs for the desired lumen output. Through a digital-to-analog converter (DAC) 865, analog signals are sent to a white pcLED driver 820, a red LED driver 830, and a green LED driver 840. Each driver then sends its own PWM (pulse width modulation) current pulse to its associated LEDs 825, 835, and 845. The resultant light through a diffuser or mixing optics 880 exhibits a CCT at 2700 K and an (u', v') coordinate 450 at (0.262, 0.530), shown in FIG. 8.

Controlling the electric current of each cluster of LEDs with proper proportions will regulate the lumen output from each LED cluster, and hence, the target CCTs. Therefore, when the lumen proportions of the pcLEDs, the red LEDs, and the green LEDs are set to be 0.4:0.275:0.325, 0.53:0.216:0.254, 0.67:0.152:0.178, 0.75:0.115:0.135, 0.85:0.07:0.08, and 0.93:0.032:0.038 for the present invention, the resultant light exhibits a CCT at 3000 K, 3500 K, 4000 K, 4500 K, 5000 K, and 5700 K, respectively. As shown in FIG. 8, the corresponding (u', v') coordinates 451, 452, 453, 454, 455, and 456 at (0.250, 0.520), (0.238, 0.510), (0.227, 0.500), (0.218, 0.492), (0.213, 0.485), and (0.205, 0.478), respectively, are along a line 460 coaxial with the Planckian locus with Duv less than 0.006. As discussed, intensity and hue vary due to random variations in producing LEDs. For the present invention, because various possible mixtures of the white pcLEDs and the intermediate LEDs that integrate red and green LEDs represent a line on the CIE 1976 (u', v') diagram, which overlays the Planckian locus and 7-step chromaticity quadrangles, variations of the LED lumen output and the associated lumen proportions of the LEDs used change the resultant coordinates substantially along the Planckian locus with the Duv less than 0.006. In other words, the present invention introduces a scheme that can be used to tune correlated color temperatures of a cool-white light such that each of the eight CCT categories defined by the Energy Star program can be reached with required Duv. In addition, because the function of the dimming switch is continuous, any position in the dimming switch can represent a lumen proportion according to the present invention (referring to FIG. 9) and thus correspond to a point on the line 460 in FIG. 8. When a user moves the dimming switch lever, the light is continuously and dynamically tuned along the line with different hues. This is one of beauties of the present invention. Meanwhile, this scheme effectively alleviates thermal dependence of the color shifts.

In general, a warm-white pcLED at CCT near 3000 K has a poor luminous efficacy, which is well below 45 lumens per watt required by the Energy Star program. The present invention uses cool-white pcLEDs with a luminous efficacy of at least 90 lumens per watt. The luminous efficacy of the resultant light mixtures of such pcLEDs and integrated red and green LED chips remains about 75 lumens per watt and above for all CCTs in the eight categories.

The red LEDs and the green LEDs in the present invention can be integrated to present a yellow hue in the range from 582 to 587 nm to mix with the white pcLEDs to generate a white light with tunable color temperatures. The preferred peak wavelength is 583 nm. In this case, the two drivers that power the red LEDs and the green LEDs can be integrated into a single LED driver. Therefore, when two LEDs at dominant wavelengths of 530 nm and 630 nm are used to generate an intermediate wavelength at 583 nm, their lumen proportion should be set at 0.541:0.459. As shown in FIG. 7, points 420, 430, and 440 represent wavelengths at 530, 630, and 583 nm, respectively. The contour 405 represents a locus of additive mixtures from LEDs with dominant wavelengths at 530 nm and 630 nm and cool-white pcLED with correlated color temperature 410 at 6500 K. All the possible mixtures using these three LEDs encircle an area 400. Taking advantages of using the two LEDs at dominant wavelengths of 530 nm and 630 nm to broaden the overall SPD of the light mixture such that its SPD substantially covers the SPD of standard illuminants, the approach provides a means to mass produce LED-based down light and light panel with CCT tunability while maintaining a CRI greater than 80.

Figure 10:
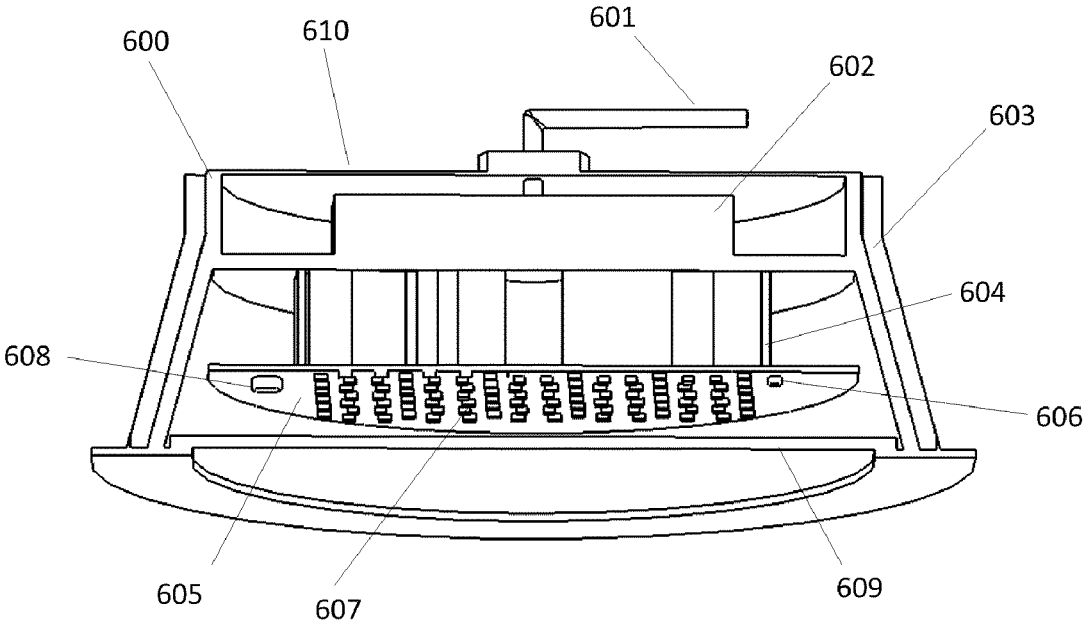
FIG. 10 is a sectional view of a luminaire with CCT tunability according to present invention.

FIG. 10 is a sectional view of a luminaire with CCT tunability according to the present invention. A metallic enclosure 600 consists of upper and lower compartments with a back cover 610. In the upper compartment, AC main is connected to a power supply through an AC input wire 601. DC power generated by the power supply then powers an integrated electronic control module 602, which comprises an AD converter, a micro-controller, a DA converter, and LED drivers. In the lower compartment, an inner heat sink 604 is attached to the top surface of the lower compartment, through which heat generated by operating LEDs 607 that directly contact the inner heat sink 604 can convey to an outer heat sink 603 to dissipate in the air. The heat exchange in this double heat sink design is so efficient that the LED PCB 605 easily stabilizes at its equilibrium temperature which in turn effectively maintains junction temperature of LEDs at a constant value. As mentioned above, an effective thermal management is essential for solid-state lighting to have satisfactory lumen and color maintenance and long lifetime. To further control total lumen output, a photo-detector 606 on the LED PCB 605 is used to monitor the intensity of LED emissions and feedback a signal to the micro-controller. Similarly, a thermocouple 608 is used to monitor the LED PCB temperature and feedback a signal to the micro-controller, which then calculates color and intensity compensations needed for possible intensity variations and color shifts due to incidental temperature variations. The use of the photo-detector and the thermocouple ensures a constant photometric emission over LEDs' service life. LEDs 607 are mounted on the LED PCB 605 using the surface mount technology. The LED PCB 605, which is an aluminum-base copper-clad laminate chemically etched to have desired circuits, has a high heat dissipation and thermal conductive capability. Because of these features, a single thermocouple on the LED PCB is enough to measure and estimate the LED junction temperature that reflects the temperature over the entire LED PCB. To ensure an effective color mixing, a mixing optics 609, which also scatters some light to the photo-detector to make it operational, is used at light exit.

Figure 11:
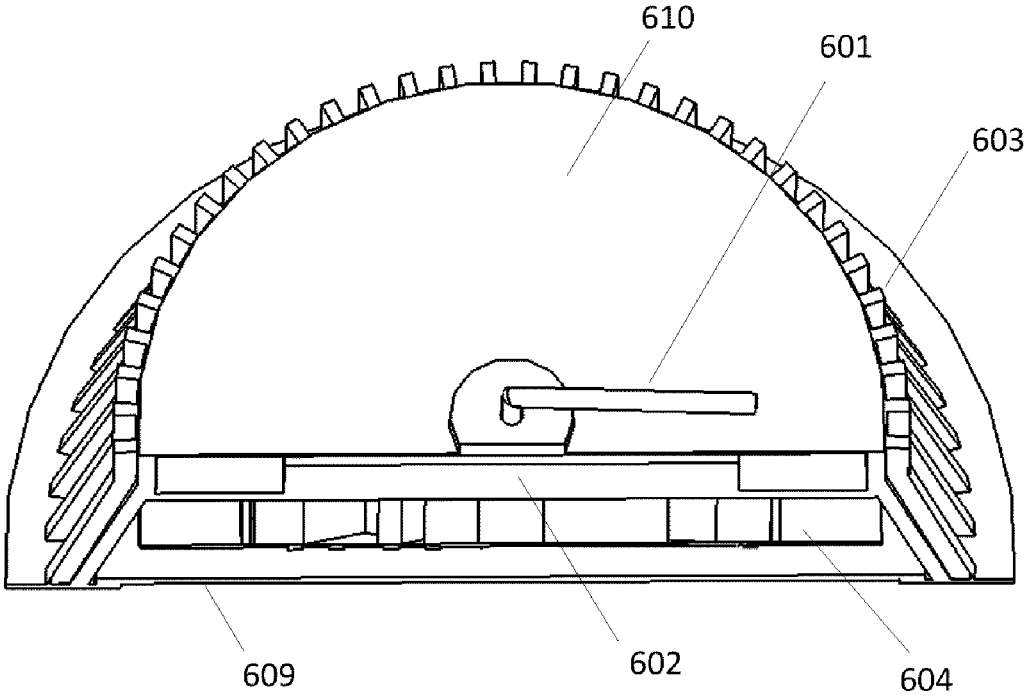
FIG. 11 is a sectional view showing double heat sinks with heat exchange.
Figure 12:
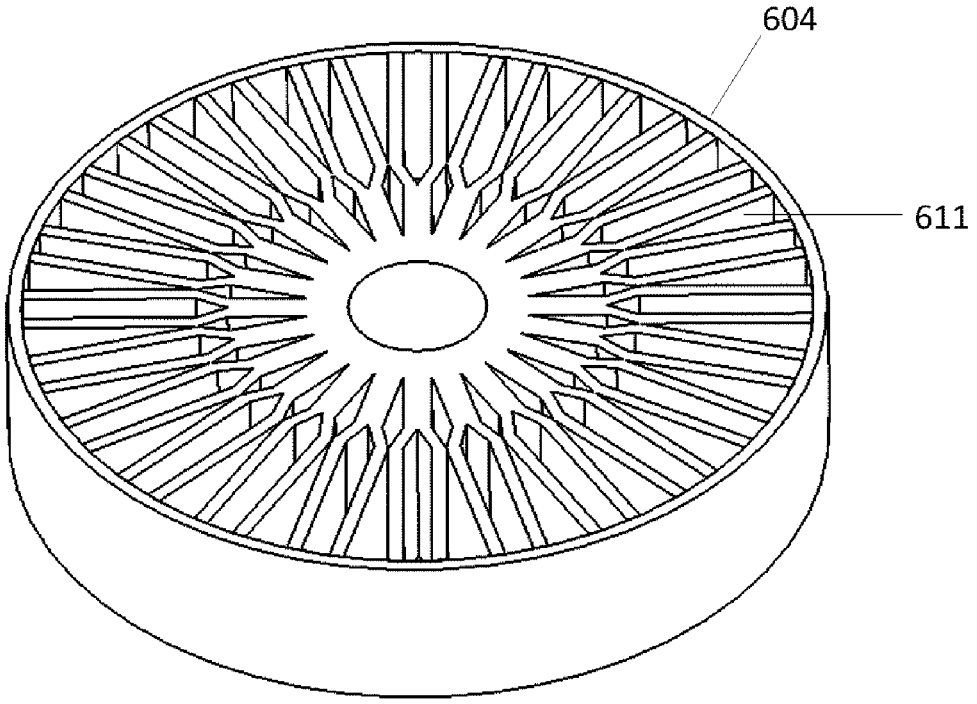
FIG. 12 is an illustration of the inner heat sink.

FIG. 11 is a top sectional view of the luminaire showing a double heat sink design with heat exchange. FIG. 12 is an illustration of the inner heat sink. The inner heat sink 604 has a radial structure 611 with copper leaves for increasing heat dissipation capability whereas the outer heat sink 603 has a toothed structure. The combination of the inner heat sink 604 and the outer heat sink 603 provides effective heat exchange between inside and outside of the luminaire, which helps the LED PCB 605 maintain a constant junction temperature over time.

Figure 13:
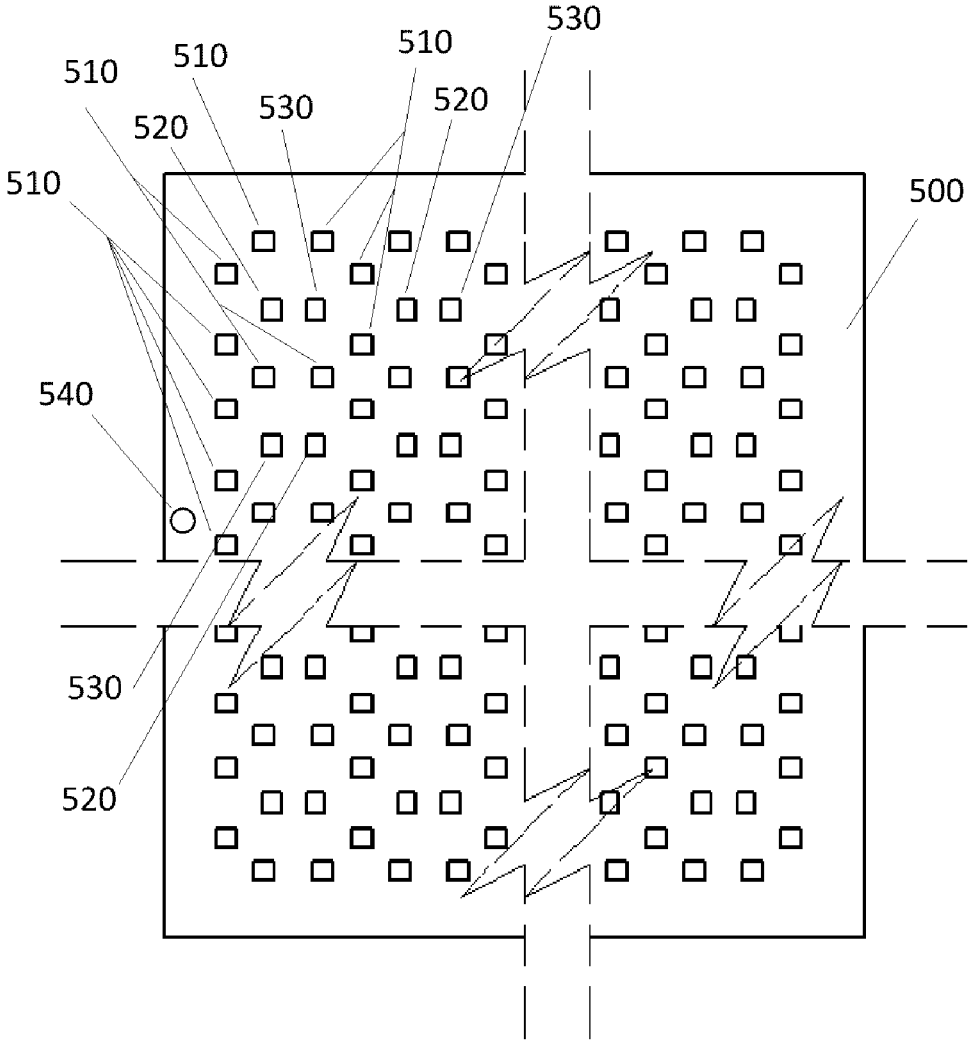
FIG. 13 is an arrangement of white pcLED arrays mixed with integrated red and green LED clusters according to the present invention.

FIG. 13 is an LED chip arrangement of white pcLED array mixed with RG LED clusters according to the present invention. All LEDs are mounted and soldered on a PCB 500 using surface mount technology. Eight white pcLEDs 510 encircle a red LED 520 and a green LED 530 to ensure uniformity of color mixing. This chip arrangement can be repeated along x and y directions as required to meet lumen output and emission pattern needs. Although shown in a rectangular manner, the LED chip arrangement is not limited to a particular shape such as circle, ellipse, square, or rectangle.

Figure 14:
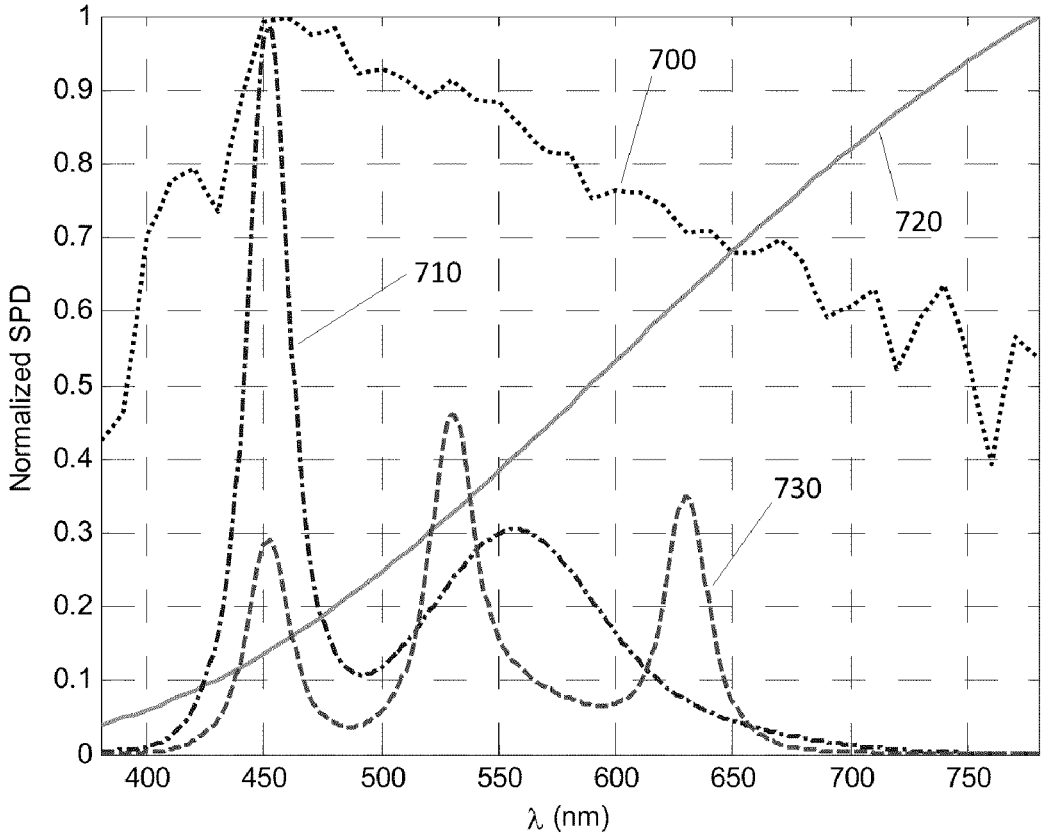
FIG. 14 shows the SPD of white pcLED and of resultant white light mixture according to present invention.

Depending on different coatings used, white pcLEDs can exhibit different hues. The primary blue emission peaks in the region from 448 to 452 nm, whereas the second peak can be in a region from 545 to 560 nm, from 550 to 565 nm, or from 575 to 590 nm, for cool white, day white, or warm white pcLEDs, respectively. Thus, such white pcLEDs have always two spectral bands in their SPD. The combination of a blue LED with a YAG phosphor in a pcLED has distinct deficiencies in the blue-green and red regions, which exhibits a poor color rendition at green and deep red colors. FIG. 14 shows the SPD 700 for the reference illuminant D65 used in testing CRI of a white pcLED. Also shown is the SPD 710 of the pcLED. Because of the differences between these two SPDs, the CRI of the pcLED under test is 70 or less. In FIG. 14, the standard illuminant A with CCT at 2856 K has a SPD 720 whereas the white light generated using the pcLEDs with CCT at 6500 K and red and green-LED combination in the present invention has a SPD 730. The resultant white light shows a CCT at 2700 K with a CRI of 80 and above. It is noticeable that the differences between the test illuminant and the reference illuminant A have been reduced, thus leading to a higher CRI value.

What is claimed is:

1. A multichip LED lighting device comprising at least two types of LED chips, which include a first type of white phosphor-coated LED chips and a second type of LED chips, wherein said first type of white phosphor-coated LED chips emits a light at a correlated color temperature of 6500K within the tolerance quadrangle defined by (0.1961, 0.4793), (0.1905, 0.4676), (0.2005, 0.4576), and (0.2055, 0.4682) on CIE 1976 UCS chromaticity diagram and said second type of LED chips emits a light emission having a saturated color with a single peak wavelength from 583 to 586 nm in its spectrum, wherein when said first and second type of LED chips are powered with a lumen proportion of X:Y, where X=0.28~0.93, and Y=1−X, emissions from said first and second type of LED chips overlap and form an effective white light having a correlated color temperature from 2700 to 5700 K along the Planckian locus on CIE 1976 UCS chromaticity diagram with Duv tolerances of ±0.006.

2. The multichip LED lighting device of claim 1, wherein the first type of white phosphor-coated LED chips emits a light emission having two peak wavelengths, one in a region from 448 to 452 nm and the other in a region from 545 to 560 nm.

3. The multichip LED lighting device of claim 1, wherein the first type of white phosphor-coated LED chips emits a light emission having two peak wavelengths, one in a region from 448 to 452 nm and the other in a region from 550 to 565 nm.

4. The multichip LED lighting device of claim 1, wherein the first type of white phosphor-coated LED chips emits a light emission having two peak wavelengths, one in a region from 448 to 452 nm and the other in a region from 575 to 590 nm.

5. A multichip LED lighting device comprising a first type of white phosphor-coated LED chips, a second type of LED chips emitting a light emission having a peak wavelength from 530 to 570 nm, and a third type of LED chips emitting a light emission having a peak wavelength from 615 to 670 nm, wherein said first type of white phosphor-coated LED chips emits a light at a correlated color temperature of 6500K within the tolerance quadrangle defined by (0.1961, 0.4793), (0.1905, 0.4676), (0.2005, 0.4576), and (0.2055, 0.4682) on CIE 1976 UCS chromaticity diagram and when the three said types of LED chips are powered with a lumen proportion of U:V:W, where U=0.28~0.93, V =(1−U)×E, and W=(1−U)×(1−E), where E=0.49~0.78933, light emissions from the three types of LED chips overlap and form an effective white light having a correlated color temperature from 2700 to 5700 K along the Planckian locus on CIE 1976 UCS chromaticity diagram with Duv tolerances of ±0.006.

6. The multichip LED lighting device of claim 5, wherein the first type of white phosphor-coated LED chips emits a light emission having two peak wavelengths, one in a region from 448 to 452 nm and the other in a region from 545 to 560 nm.

7. The multichip LED lighting device of claim 5, wherein the first type of white phosphor-coated LED chips emits a light emission having two peak wavelengths, one in a region from 448 to 452 nm and the other in a region from 550 to 565 nm.

8. The multichip LED lighting device of claim 5, wherein the first type of white phosphor-coated LED chips emits a light emission having two peak wavelengths, one in a region from 448 to 452 nm and the other in a region from 575 to 590 nm.

9. A multichip LED lighting device comprising:

an LED printed circuit board (PCB);

a micro-controller;

a first type of LEDs, a second type of LEDs, and a third type of LEDs, mounted on the LED PCB, wherein the first type of LEDs is a white phosphor-coated LED;

three LED drivers, each of which provides a pulse width modulation current to a respective one of the three types of LEDs; and a color mixing diffuser, which receives light emissions from said three types of LEDs and emits a light emission having at least three different spectral bands that mix to form a white light, wherein the micro-controller receives a signal from a user interface, calculates a lumen proportion for emissions from the three types of LEDs according to the signal received; and sends a signal reflecting the lumen proportion to each of the three LED drivers for setting the pulse width modulation current accordingly; and wherein the second type of LEDs has a peak wavelength from 530 to 570 nm, the third type of LEDs has a peak wavelength from 615 to 670 nm, and the LED chips on the LED PCB are arranged in such a way that eight first type of LEDs encircle an LED of the second type and an LED of the third type.

10. The multichip LED lighting device of claim 9, wherein the first type of white phosphor-coated LED chips emits a light emission having two peak wavelengths, one in a region from 448 to 452 nm and the other in a region from 545 to 560 nm.

11. The multichip LED lighting device of claim 9, wherein the first type of white phosphor-coated LED chips emits a light emission having two peak wavelengths, one in a region from 448 to 452 nm and the other in a region from 550 to 565 nm.

12. The multichip LED lighting device of claim 9, wherein the first type of white phosphor-coated LED chips emits a light emission having two peak wavelengths, one in a region from 448 to 452 nm and the other in a region from 575 to 590 nm.

13. The multichip LED lighting device of claim 10, wherein the human interface is a dimmer or a dimming switch.

14. The multichip LED lighting device of claim 9, wherein the LED driver associated with the second type of LEDs and the LED driver associated with the third type of LEDs are integrated in a single LED driver.

* * * * *